US009466211B1

(12) United States Patent
Gesmundo

(10) Patent No.: US 9,466,211 B1
(45) Date of Patent: Oct. 11, 2016

(54) EARLY WARNING SYSTEM OF EMERGENCY VEHICLES FOR ALERTING ROADWAY TRAFFIC

(71) Applicant: Roberto Gesmundo, E. Northport, NY (US)

(72) Inventor: Roberto Gesmundo, E. Northport, NY (US)

( * ) Notice: Subject to any disclaimer, the term of this patent is extended or adjusted under 35 U.S.C. 154(b) by 232 days.

(21) Appl. No.: 14/303,414

(22) Filed: Jun. 12, 2014

(51) Int. Cl.

| | |
|---|---|
| ***G08G 1/0967*** | (2006.01) |
| ***G08G 1/09*** | (2006.01) |
| ***F21S 8/08*** | (2006.01) |
| ***F21S 9/03*** | (2006.01) |
| *F21Y 105/00* | (2016.01) |

(52) U.S. Cl.
CPC ..... *G08G 1/091* (2013.01); *F21S 8/086* (2013.01); *F21S 9/037* (2013.01); *F21Y 2105/001* (2013.01)

(58) Field of Classification Search
CPC ..... G08G 1/091; G08G 1/00; G08G 1/01; G08G 1/0104; G08G 1/017; G08G 1/02; G08G 1/048; G08G 1/052; G08G 1/087; G08G 1/009; G08G 1/09; G08G 1/127; G08G 1/13; G08G 1/133
USPC ..... 340/905, 902, 522, 540, 435, 907, 936, 340/468, 575, 331, 464, 438, 901, 925, 906
See application file for complete search history.

(56) References Cited

U.S. PATENT DOCUMENTS

| | | | | |
|---|---|---|---|---|
| 3,416,129 | A | 12/1968 | Dean | |
| 3,568,161 | A | 3/1971 | Knickel | |
| 3,792,445 | A | 2/1974 | Bucks et al. | |
| 5,161,345 | A * | 11/1992 | Sobjack, Sr. | E04B 7/022 33/613 |
| 6,779,134 | B1 * | 8/2004 | Laviolette | G06F 11/3006 714/38.12 |
| 7,409,294 | B2 | 8/2008 | Mead et al. | |
| 7,791,463 | B2 | 9/2010 | Rountree | |
| 7,831,379 | B2 | 11/2010 | Nathan et al. | |
| 8,237,555 | B2 | 8/2012 | McCarthy | |
| 2004/0128888 | A1 | 7/2004 | Payan et al. | |
| 2004/0178684 | A1 * | 9/2004 | Joong | H02K 41/031 310/12.24 |
| 2007/0223996 | A1 * | 9/2007 | Green | G08G 1/0955 404/9 |
| 2008/0062675 | A1 * | 3/2008 | Tung | E04H 15/10 362/102 |
| 2012/0126996 | A1 | 5/2012 | McCarthy | |
| 2013/0187792 | A1 * | 7/2013 | Egly | G08G 1/0965 340/901 |
| 2013/0297197 | A1 | 11/2013 | Zhai et al. | |

* cited by examiner

*Primary Examiner* — Andrew Bee
*Assistant Examiner* — Mancil Littlejohn, Jr.
(74) *Attorney, Agent, or Firm* — Richard L. Miller

(57) ABSTRACT

An early warning system for alerting traffic which comprises a plurality of roadside signals, a computer, and a communications network. Each roadside signal comprises LED illumination devices, solar power sources, battery energy storage, a flexible backing, and attachment straps. The signals are activated to alert traffic to stopped responder vehicles, and can be automatically activated when a responder vehicle performs such actions as stopping or turning its emergency lights on. The system also allows for centralized user control.

16 Claims, 10 Drawing Sheets

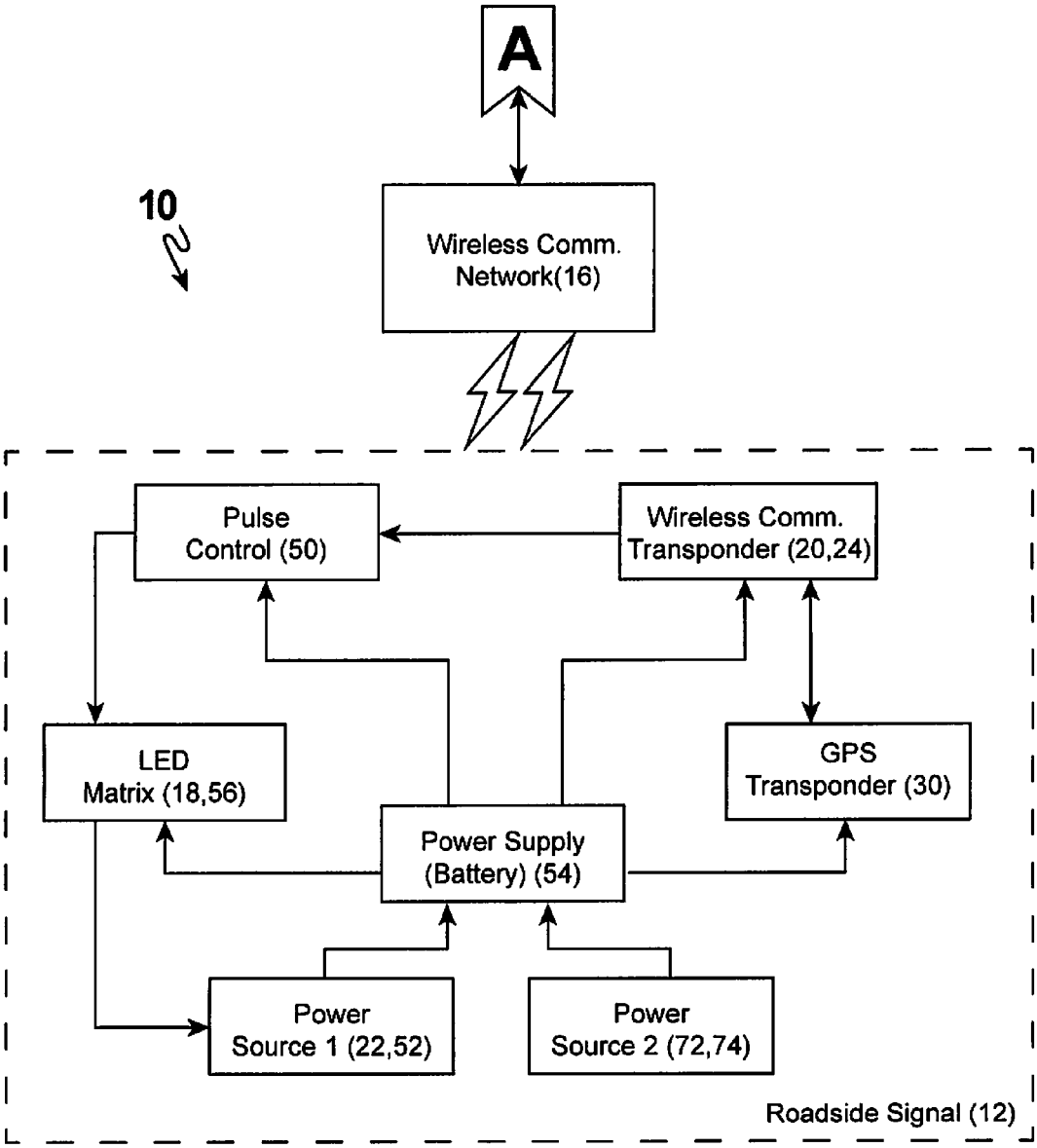
Fig.10-A

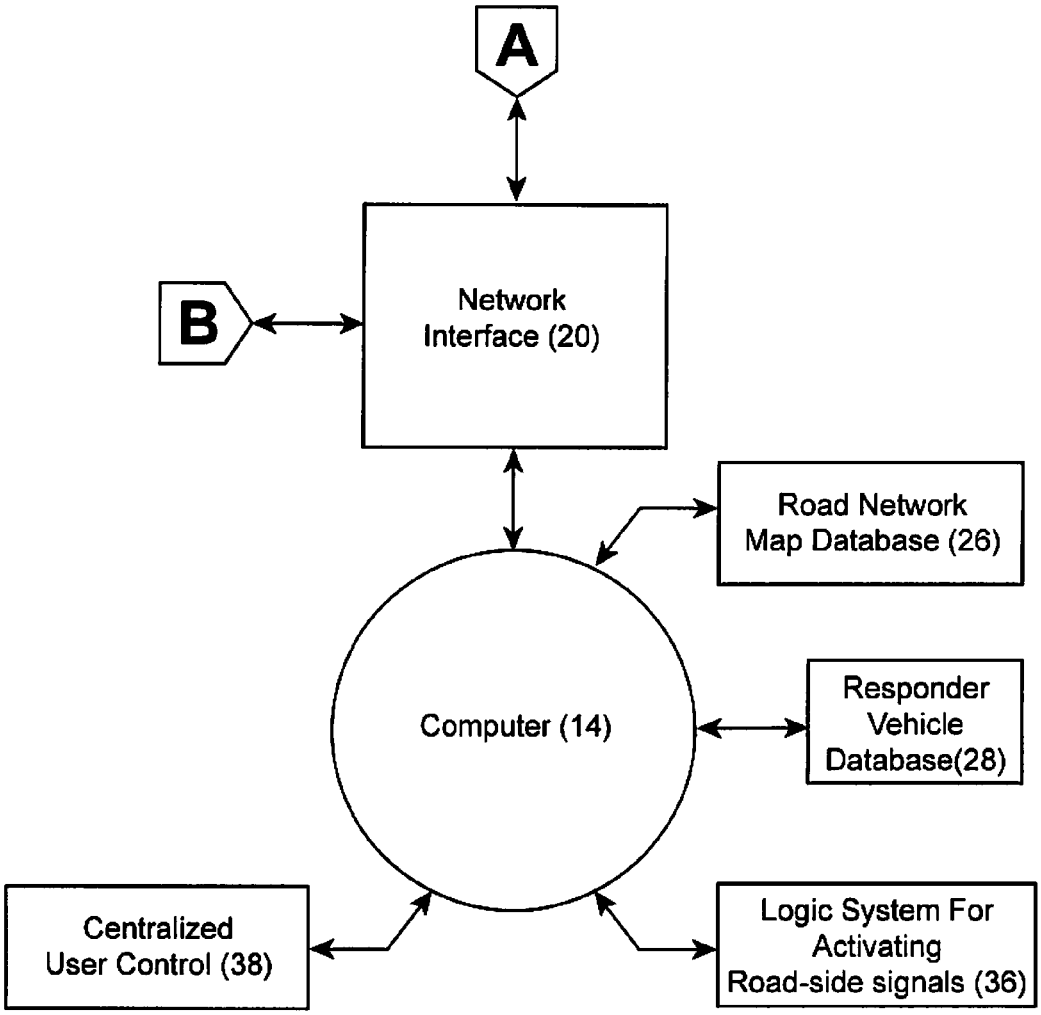
*Fig.10-B*

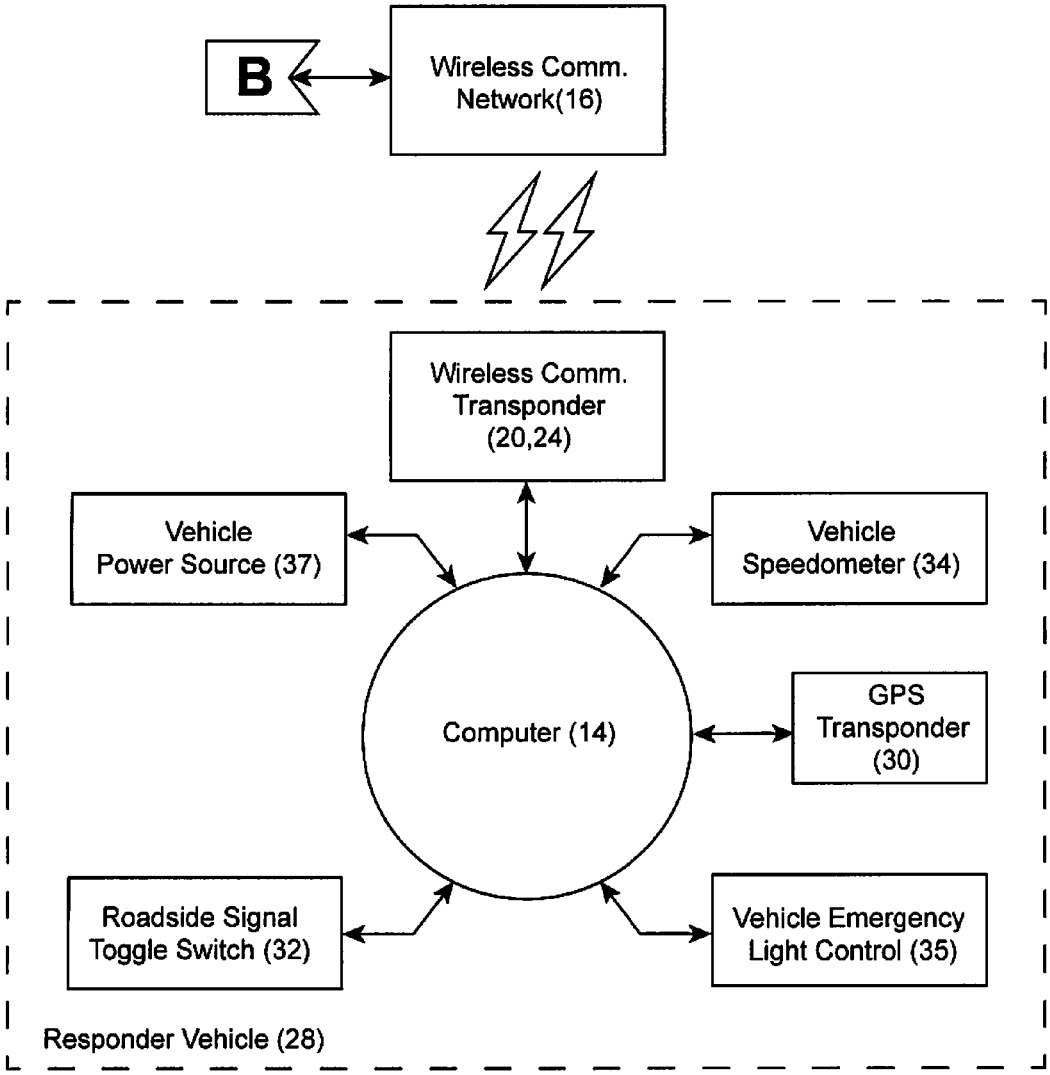
*Fig.10-C*

EARLY WARNING SYSTEM OF EMERGENCY VEHICLES FOR ALERTING ROADWAY TRAFFIC

BACKGROUND OF THE INVENTION

1. Field of the Invention

The present invention relates to a(n) device and system for alerting vehicles to road hazards, and more particularly, an EARLY WARNING SYSTEM OF EMERGENCY VEHICLES FOR ALERTING ROADWAY TRAFFIC.

2. Description of the Prior Art

Numerous innovations for systems for alerting traffic to hazards have been provided in the prior art that will be described. Even though these innovations may be suitable for the specific individual purposes to which they address, however, they differ from the present invention.

A FIRST EXAMPLE, U.S. Pat. No. 3,416,129, Published/Issued on Dec. 10, 1968, to Dean teaches a vehicle alarm system for warning to a vehicle's occupants of its approach to a railway or other vehicular crossing, but the invention may be used to warn of a moving object such as the train itself, as distinct from the crossing, or to warn of a through highway or to warn of an open bridge or the like.

A SECOND EXAMPLE, U.S. Pat. No. 3,568,161, Published/Issued on Mar. 2, 1971, to Knickel teaches a system for automatically locating vehicles within a prescribed area utilizes an emitter comprising a cded transmitted device carried by each vehicle, a plurality of sensor stations disposed at preselected locations within the prescribed area for receiving vehicle identification-coded signals from nearby vehicles, a vehicle identification decoder for processing of coded signals received by the sensor stations, and a digital computer for processing decoded information to locate each vehicle on the basis of which sensor station most recently received that vehicle's coded signal. The system may be utilized for police car location, whereby existing police call boxes may be utilized as sensor locations, and wherein a display mat is provided on which lamps are lighted to indicate the presence of a police car sufficiently close to a call box to have its signal received thereby. Apart from the identification code, additional coded information may be emitted indicating vehicle status (i.e. fully loaded bus, in a bus locator system) or emergency situations.

A THIRD EXAMPLE, U.S. Pat. No. 3,792,445, Published/Issued on Feb. 12, 1974, to Bucks, et al. teaches a vehicle data recording system comprising a plurality of vehicle condition sensors and a route location selector which furnish corresponding digital data which is processed and periodically fed to a magnetic tape cassette recorder, or the like, for recording on magnetic tape. The magnetic tape is advanced only periodically and the data is recorded without significant gaps between the words, such that several days of data may be recorded on a single tape cassette for subsequent storage or analysis.

A FOURTH EXAMPLE, U.S. Pat. No. 7,409,294, Published/Issued on Aug. 5, 2008, to Mead, et al. teaches an enhanced police Doppler direction sensing radar detects possibly dangerous traffic conditions during certain vehicle maneuvers such as U-turns and returns to travel after roadside stops. By monitoring a host or primary vehicle speed, speed transitions, transmission state (e.g. gear selection), and the closing vehicle position, range and speed, a number of selectable conditions are detected, resulting in an alert indication to a primary vehicle operator. User preferences and thresholds allow the traffic alert function to be customized according to a primary vehicle operator's desire to suppress alerts in situations which the user does not deem dangerous. The traffic alert function may be automatically triggered under certain detected conditions, or manually initiated when the primary vehicle operator intends to make a driving maneuver.

A FIFTH EXAMPLE, U.S. Pat. No. 7,791,463, Published/Issued on Sep. 7, 2010, to Rountree teaches a Universal Help Light which is a rectangular shaped light that is positioned or mounted along the rear windshield of an automobile.

When the light is connected to the vehicles flasher system, it flashes the word "H E L P" concurrently with the auto's hazard or emergency flashers.

The light flashes as described, to give clear notice that help is needed and is being summoned.

A SIXTH EXAMPLE, U.S. Pat. No. 7,831,379, Published/Issued on Nov. 9, 2010, to Nathan, et al. teaches a method and system to alert drivers to driving related information thought controlling information displayed on one or more roadside displays. The displayed information may related to traffic flow, road conditions, emergencies, and any other type of information. Optionally, the displayed information may be determined at least in part of data collected from onboard the vehicles.

A SEVENTH EXAMPLE, U.S. Pat. No. 8,237,555, Published/Issued on Aug. 7, 2012, to McCarthy teaches a hazardous vehicle alert system comprising a control module, a special graphical user interface, a speed and distance detector, and an alarm module where the user sets alarm triggers based on reaction time until potential impact from the hazardous vehicle. The user can assess the landscape, traffic patterns, and specifics of the task at hand to determine the required reaction time to take evasive maneuvers from the threat of on-coming hazardous vehicles and create alarm triggers to yield this reaction time. A software package is used to drive the graphical user interface, control module, alarm module, and detector module. The system includes modes ranging from one to four pieces and a mode that can be installed in a vehicle.

AN EIGHTH EXAMPLE, U.S. Patent Office Document No. 20040128888, Published/Issued on Jul. 8, 2004, to Payan, et al. teaches an alert device is provided that includes a light producing surface, The alert device has a stored configuration in which the light producing surface is compacted and the visible area of the light producing surface is decreased. The alert device also has a deployed configuration in which the visible area of the light producing surface is increased. A microprocessor is used to control light producing elements on the light producing surface to produce desired symbols.

A NINTH EXAMPLE, U.S. Patent Office Document No. 20120126996, Published/Issued on May 24, 2012, to McCarthy teaches a hazardous vehicle alert system comprising a control module, a special graphical user interface, a global positioning system device, a speed and distance detector, and an alarm module where the user sets alarm triggers based on reaction time until potential impact from the hazardous vehicle. The user can assess the landscape, traffic patterns, and specifics of the task at hand to determine the required reaction time to take evasive maneuvers from the threat of on-coming hazardous vehicles and create alarm triggers to yield this reaction time. A software package is used to drive the graphical user interface, control module, alarm module, and detector module. The system includes modes ranging from one to four pieces and a mode that can be installed in a vehicle.

A TENTH EXAMPLE, U.S. Patent Office Document No. 20130297197, Published/Issued on Nov. 7, 2013, to Zhai, et al. teaches a system for guiding a driver of a vehicle is disclosed. The system comprises a light sensor configured to detect light; and a processor configured to determine a position of vehicle on a roadway based on a characteristic of the detected light.

It is apparent now that numerous innovations for systems for alerting drivers have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide an EARLY WARNING SYSTEM OF EMERGENCY VEHICLES FOR ALERTING ROADWAY TRAFFIC that avoids the disadvantages of the prior art.

ANOTHER OBJECT of the present invention is to provide an EARLY WARNING SYSTEM OF EMERGENCY VEHICLES FOR ALERTING ROADWAY TRAFFIC that is simple and inexpensive to manufacture.

STILL ANOTHER OBJECT of the present invention is to provide an EARLY WARNING SYSTEM OF EMERGENCY VEHICLES FOR ALERTING ROADWAY TRAFFIC that is simple to use and install on existing roadways.

BRIEFLY STATED, STILL YET ANOTHER OBJECT of the present invention is to provide an EARLY WARNING SYSTEM OF EMERGENCY VEHICLES FOR ALERTING ROADWAY TRAFFIC that permits automatic activation of the signals according to an logic system, while also providing override options for a human controller.

LASTLY, the signal of the present invention is designed to be self-powering and self-containable, so that it can be deployed without need for expensive supporting infrastructure.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIGS. 10-A, 10-B and 10-C form a block diagram which shows the cooperation among electrical components, mechanical components and software of the system.

A MARSHALING OF REFERENCE NUMERALS UTILIZED IN THE DRAWING

Figure 1:
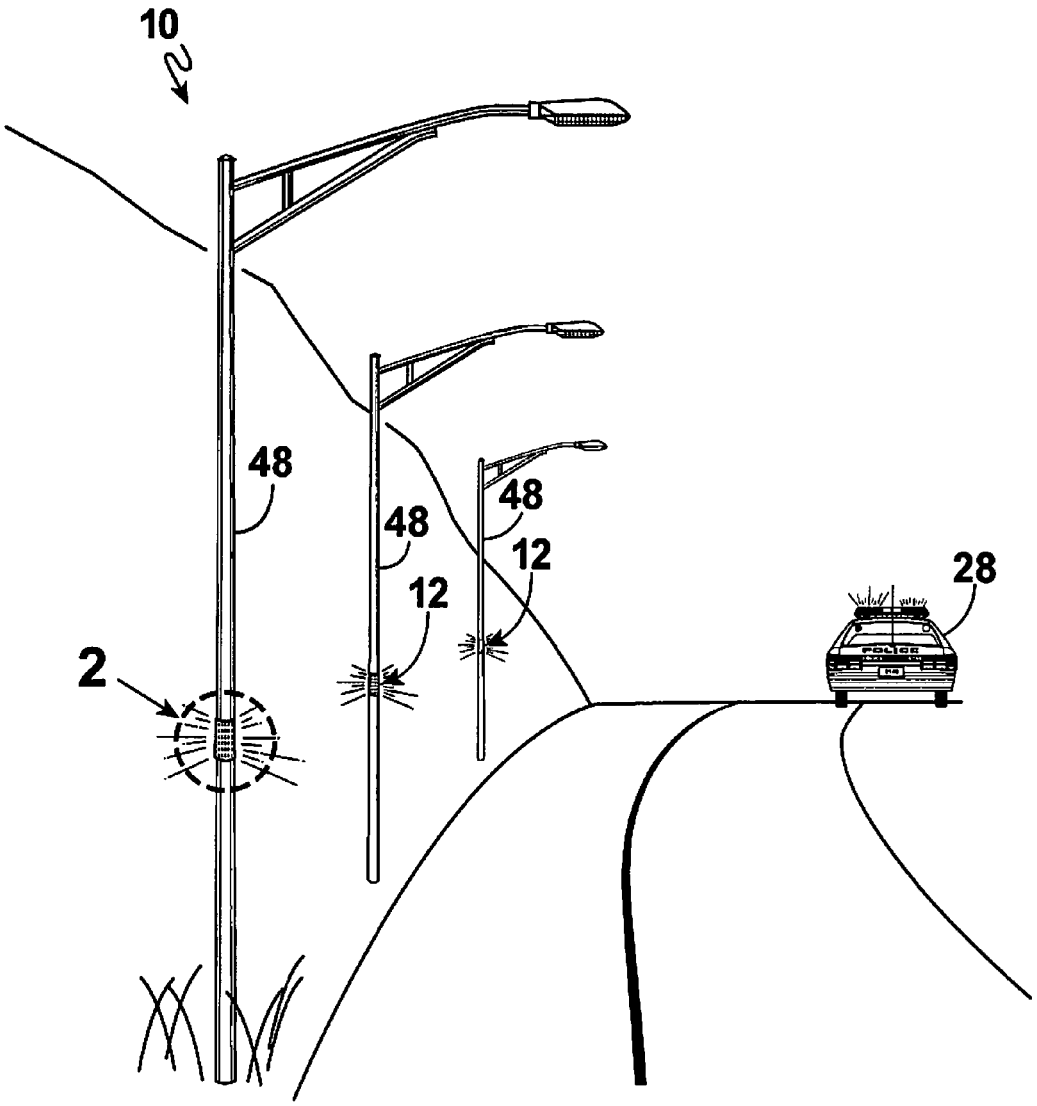
FIG. 1 is a diagrammatic perspective view illustrating an embodiment of the road-side signals of the present invention in use on a highway while physically installed on utility lighting poles.
Figure 2:
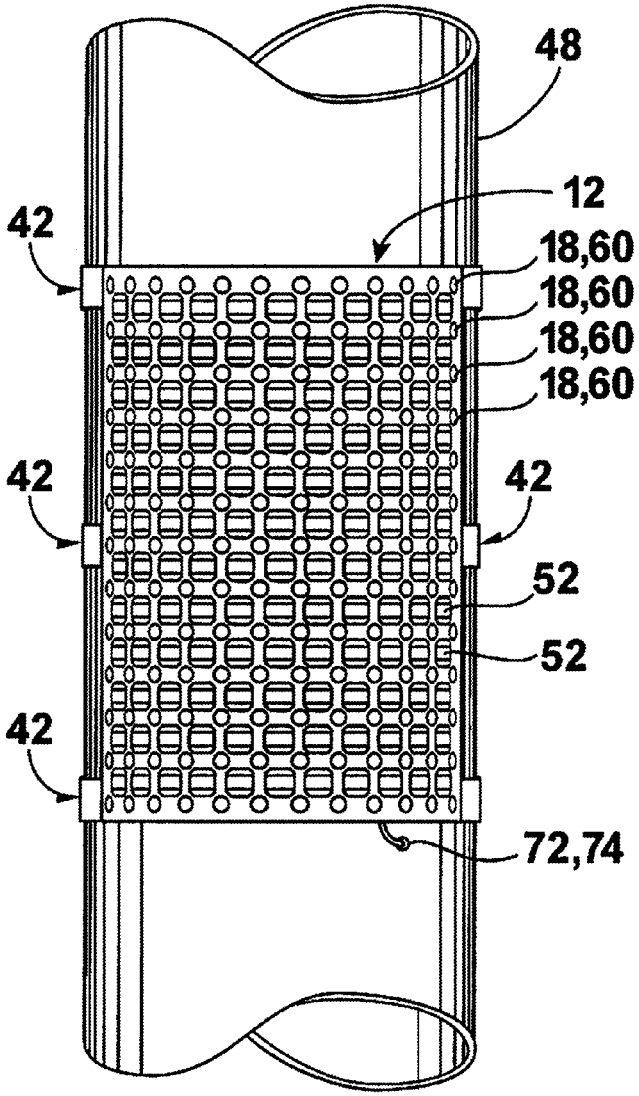
FIG. 2 is an enlarged diagrammatic perspective view of the area enclosed in the dotted circle indicated by arrow 2 in FIG. 1 showing a first embodiment of the invention in greater detail strapped around a ferrous pole.

10 early warning system for alerting traffic
12 roadside signal
14 computer
16 communications network
18 illumination device
20 communications interface
22 power source
24 wireless transponder
26 road network database
28 responder vehicle
30 Global Positioning System transponder
32 roadside signal 12 toggle switch
34 responder vehicle 28 speedometer
35 responder vehicle 28 emergency light control 35
36 logic system for activating roadside signals 12
37 responder vehicle 28 power source
38 centralized user control
42 attachment straps of roadside signal 12
44 securement device of roadside signal 12
46 flexible backing of roadside signal 12
48 streetlight
49 utility pole
50 pulse control circuit
52 solar panel
54 battery
56 regular pattern of illumination devices 18
58 space between illumination devices 18
60 light emitting diode illumination device 18
62 proximal face of attachment strap 42
64 distal face of attachment strap 42
66 permanent magnet
68 regularly spaced openings in attachment strap 42
70 grommet
72 backup power source
74 connection to power grid

DETAILED DESCRIPTION OF THE PREFERRED EMBODIMENT

Referring now to the figures, in which like numerals indicate like parts, and particularly to FIGS. 1 and 10-A, B, and C, disclosed is an early warning system 10 for alerting traffic. The present invention comprises an integrated system 10 for such signaling, as well as a particular embodiment of a roadside signal 12 for use in the system. The purpose of the system 10 is in particular to alert drivers to the presence of emergency responder vehicles 28 so that they can slow down and avoid collisions.

Detailed Description of the Early Warning System 10

In its essentials, the early warning system 10 for alerting traffic comprises:

a) a plurality of roadside signals 12;

b) a computer 14; and c) a communications network 16;

The plurality of roadside signals 12 in turn each comprise:

a) a plurality of illumination devices 18;

b) a communications interface 20; and c) at least one power source 22;

The roadside signals 12 communicate through the communications interface 20 over the communications network 16 with the computer 14. Based on this communication, the computer 14 may cause some or all of the plurality of roadside signals 12 to illuminate their illumination devices 18 for the purpose of alerting traffic.

Preferably, to best achieve the goal of alerting traffic, the computer 14 may cause some or all of the roadside signals 12 to pulse their illumination devices 18.

In a preferred embodiment, the communications network 16 is a wireless communications network, and correspondingly the communications interface 20 of the roadside signal 12 is a wireless communications transponder 24. In practical usage, this communications network 20 may utilize pre-existing mobile communications networks such as cellular telephony and data networks. This permits the network to be installed at lower expense because wireless networks avoid having to run communication cables to each signal.

To accomplish its control of the various roadside signals 12, the computer 14 will have access to a road network database 26. The road network database 26 contains information about the locations of the roadside signals 12 on a road network. The computer 14 therefore may be used to select roadside signals 12 for illumination based on their locations.

Detailed Description of the Responder Vehicle 28

The system's control scheme preferably uses integration with responder vehicles 28. Thus, the system has at least one responder vehicle 28. And the at least one responder vehicle 28 is in communication with the computer 14 via the wireless communications network 16. Responder vehicles 28 are vehicles such as police cars, ambulances, fire trucks, tow trucks, maintenance vehicles, or other vehicles which may regularly have to stop on a roadway or shoulder.

For the system 10 to operate effectively, each responder vehicle 28 has a Global Positioning System transponder 30 thereon. Thus, the a location of a responder vehicle 28 ascertained by the Global Positioning System location means 30 can be communicated to the computer 14 via the wireless communications network.

Each responder vehicle 28 additionally has a roadside signal toggle switch 32. The roadside signal toggle switch 32 is for selectively activating or deactivating roadside signals 12 which are on the same road as the location of said responder vehicle and which are within a pre-determined proximity of said responder vehicle.

In addition to the toggle switch 32, each vehicle has a speedometer 34. The speedometer 34 communicates with the computer 14 via the wireless communications network 16. In a preferred embodiment, the toggle switch is integrated with the responder vehicle's 28 emergency light control 35, thus allowing easy activation of both roadside signals 12 and emergency lights on the responder vehicle 28 at the same time.

The computer 14 operates a logic system 36 for activating roadside signals 12. The logic system 36 is for automatically activating some of the roadside signals 12 when certain conditions are met, and for deactivating the roadside signals 12 when other conditions are met. The logic system in a preferred embodiment utilizes data from the speedometer 34 and the toggle switch 32 to make its determinations. For example, the logic system 34 may activate roadside signals 12 in a radius of a stopped vehicle 28 if the speedometer 35 reads below a certain value, and the toggle switch 32 and emergency light control 35 are active. The responder vehicle 28 systems are powered by the responder vehicle 28 power source, 37 which is usually its battery.

Detailed Description of the Centralized User Control 38

In the preferred embodiment of the system 10, the computer 14 is connected to a centralized user control 38. The centralized user control 38 may activate or deactivate roadside signals 12 selectively.

The centralized user control 38 has ultimate control over the activation or deactivation of roadside signals 12, and may deactivate signals 12 activated by the toggle switches 32 of the responder vehicles 28, or the logic system 36, or activate any inactive roadside signal 12. The purpose of this is to allow a human controller ultimate power over activation or deactivation of signals 12. Therefore, in a preferred embodiment, the centralized user control 38 is operated by a human being.

To facilitate same, the centralized user control 38 may lock out any toggle switch 32 or the logic system 36 from activating roadside signals 12.

Detailed Description of the Roadside Signal 12

Referring now to FIGS. 2-9 critical part of the present invention is the roadside signal 12 itself. Therefore, the signal 12 of the preferred embodiment is described in some detail.

The roadside signal comprises at least:

a) a plurality of illumination devices 18;

b) a power source 22;

c) a plurality of attachment straps 42;

d) a plurality of securement devices 44; and e) a flexible backing 46.

The plurality of illumination devices 18 are for alerting vehicles to a hazard. The power source 22 is for powering the plurality of illumination devices 18. The plurality of attachment straps 42 are for encircling a streetlight 48, utility pole 49, or other appropriate location for mounting a roadside signal 12. The plurality of securement devices 44 are for securing the roadside signal 12 to the utility pole 49, streetlight 48, or other appropriate location for mounting the signal 12. The flexible backing 46 is for holding the plurality of illumination devices 18 in place.

In the preferred embodiment, the signal further comprises a pulse control circuit 50. The pulse control circuit 50 is for pulsing the plurality of illumination devices 18 to better alert vehicles. This is because in general, a pulsing light will attract more attention than a solidly on light.

In a preferred construction, the power source 22 comprises at least one solar panel 52 and at least one battery 54. The at least one battery 54 powers the illumination device 18 and is powered by the at least one solar panel 52. The advantages of a solar powered roadside signal 12 are numerous. First, using solar panels 52 and battery 54 storage allows the signal 12 to be self-sufficient. When combined with the use of a wireless transponder 24, a signal 12 can be installed without need of connection to any wired communication or power grid, and can remain operational for an extremely extended period. This provides an advantage over many prior art methods which rely on wired connections.

Figure 3:
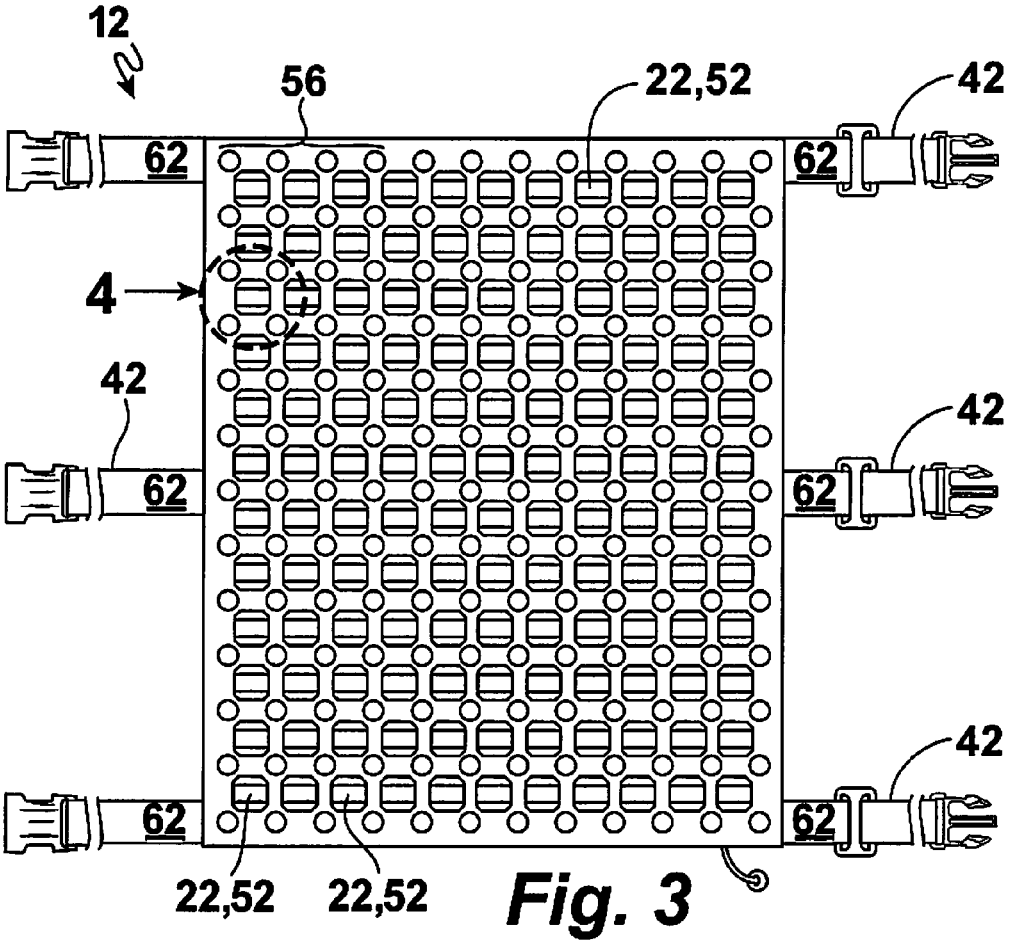
FIG. 3 is a plan view thereof showing the side of road-side signal which has the solar panels and the LED matrix facing outwardly away from the pole's surface.
Figure 4:
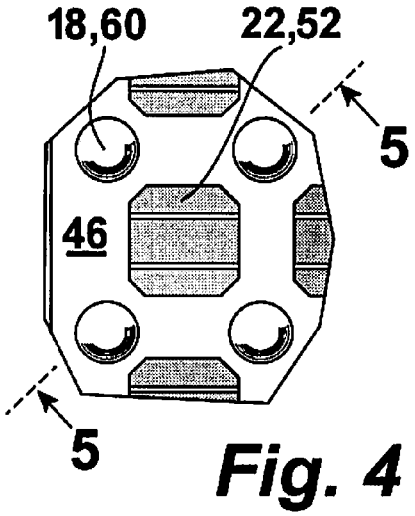
FIG. 4 is an enlarged diagrammatic plan view of the area enclosed in the dotted circle indicated by arrow 4 in FIG. 3 showing the solar panels and the LED matrix in greater detail.
Figure 5:
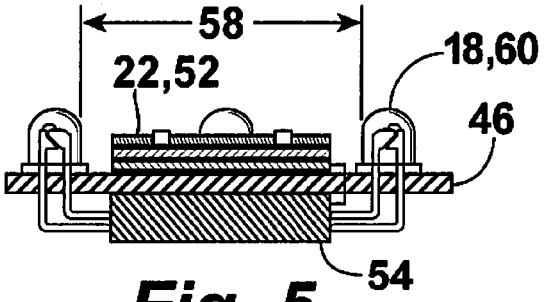
FIG. 5 is a cross sectional view taken on line 5-5 in FIG. 4.

In the preferred construction, which is particularly illustrated in FIGS. 3, 4, and 5, the plurality of illumination devices 18 are arranged in a regular pattern 56, with spaces 58 between the plurality of illumination devices 18. As seen in FIG. 3, the at least one solar panel 52 comprises a plurality of solar panels 52, and the plurality of solar panels 52 are each located, as seen in FIG. 4, in the spaces 58 between the illumination devices 18. In the preferred construction, the plurality of illumination devices 18 comprise a plurality of light emitting diode illumination devices 60. Light emitting diodes 60 generally use less electricity than traditional incandescent bulbs, and are also ordinarily smaller, making more space for the solar panels to fit between the light emitting diodes 60.

Likewise to the solar panels 52, in the preferred construction, the at least one battery 54 comprises a plurality of batteries 54. The plurality of batteries 54 corresponds to the plurality of solar panels 52. This permits each of said plurality of batteries 54 to be mounted behind a corresponding solar panel 52.

Detailed Description of the First Embodiment of Attachment Straps 42 and Securement Devices 44

Figure 6:
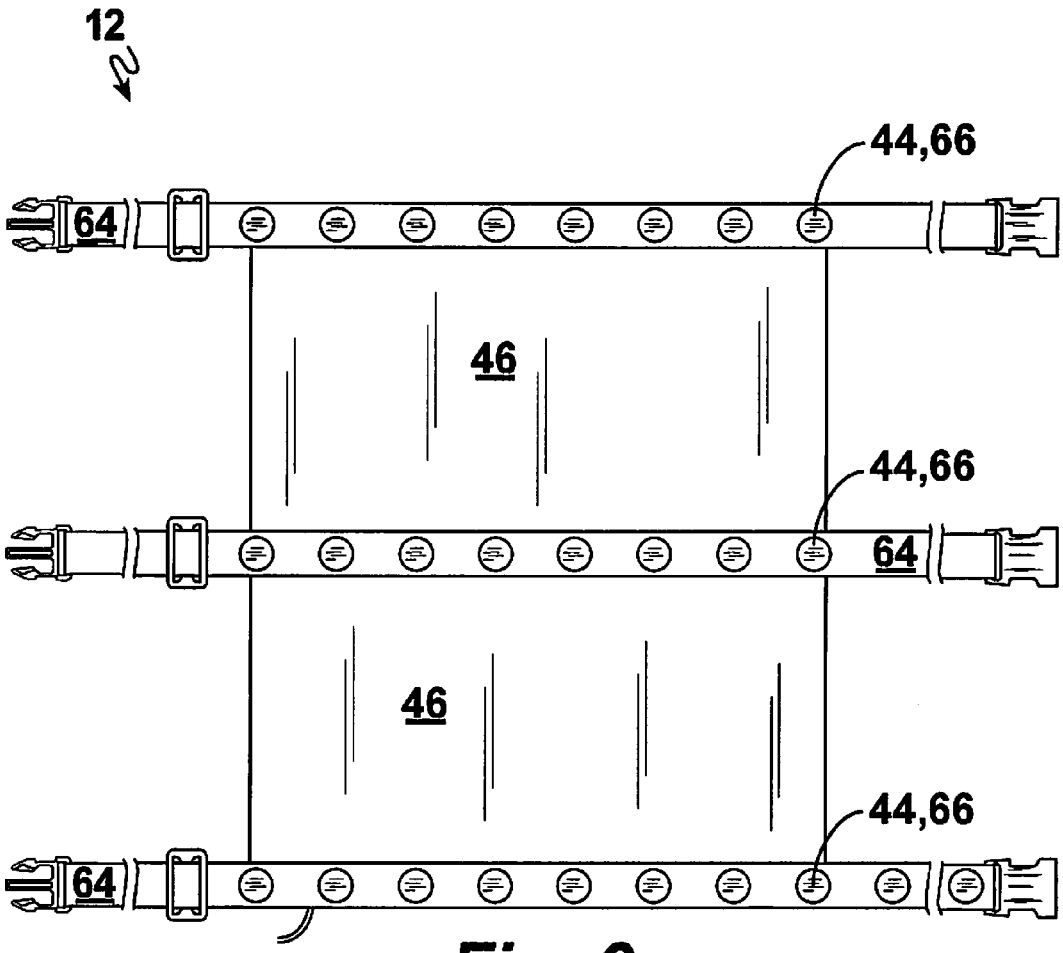
FIG. 6 is a plan view showing the side of road-side signal which has the a plurality of securing magnetic mounting components facing inwardly towards the pole's surface.

Disclosed are two embodiments of the roadside signal 12 of the present invention. The first embodiment, disclosed here, and in FIGS. 3 and 6, is intended for attaching the roadside signal 12 to a metal pole of a streetlight 49.

In the first embodiment, the attachment straps 42 have a proximal face 62 and a distal face 64. At least part of the proximal face 62 is permanently secured to the flexible backing 46 of the roadside signal 12. The distal face 64 abuts the streetlight 49, or other appropriate location for mounting the signal 12.

The securement device 44 of the first embodiment comprises permanent magnets 66. The permanent magnets 66 are mounted on the distal face 64 of the attachment straps 42. The permanent magnets 66 are for securing the roadside signal 12 to a utility pole 49, streetlight 48, or other appropriate location which is substantially ferromagnetic.

Detailed Description of the Second Embodiment of Attachment Straps 42 and Securement Devices 44

Figure 7:
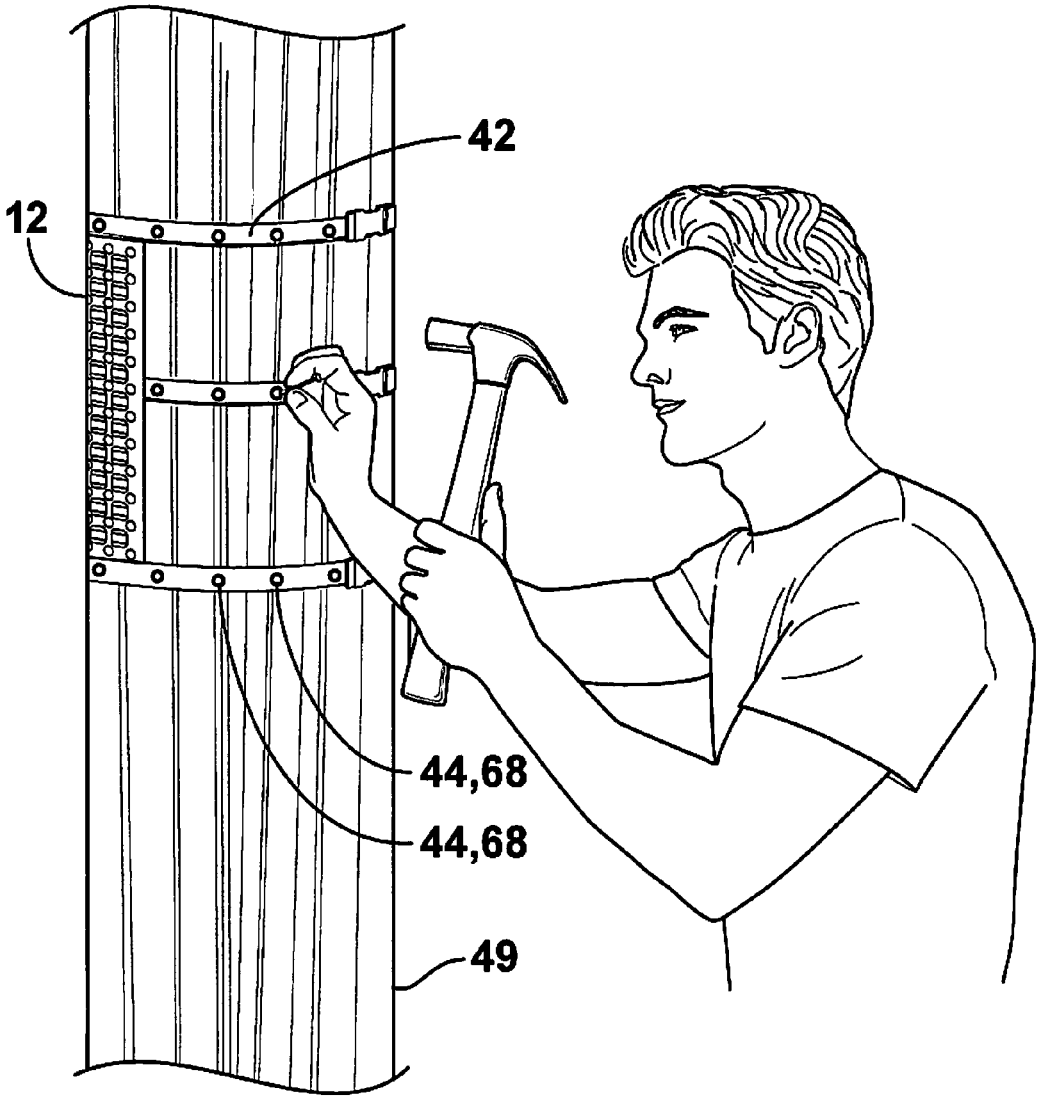
FIG. 7 is an enlarged diagrammatic perspective view of the area enclosed in the dotted circle indicated by arrow 2 in FIG. 1 showing a second embodiment of the invention in greater detail strapped around a wooden pole.
Figure 8:
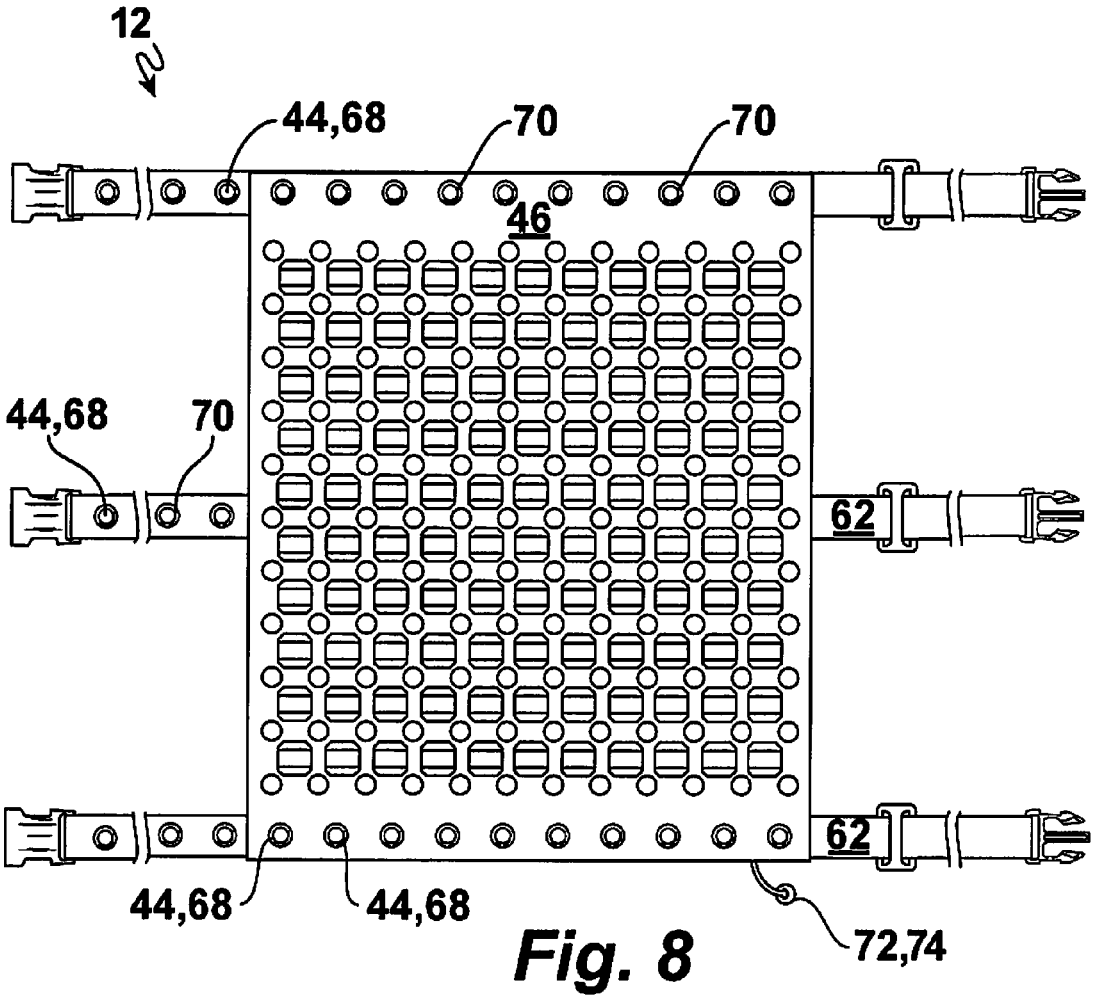
FIG. 8 is a plan view thereof showing the side of road-side signal which has the solar panels and the LED matrix facing outwardly away from the pole's surface.
Figure 9:
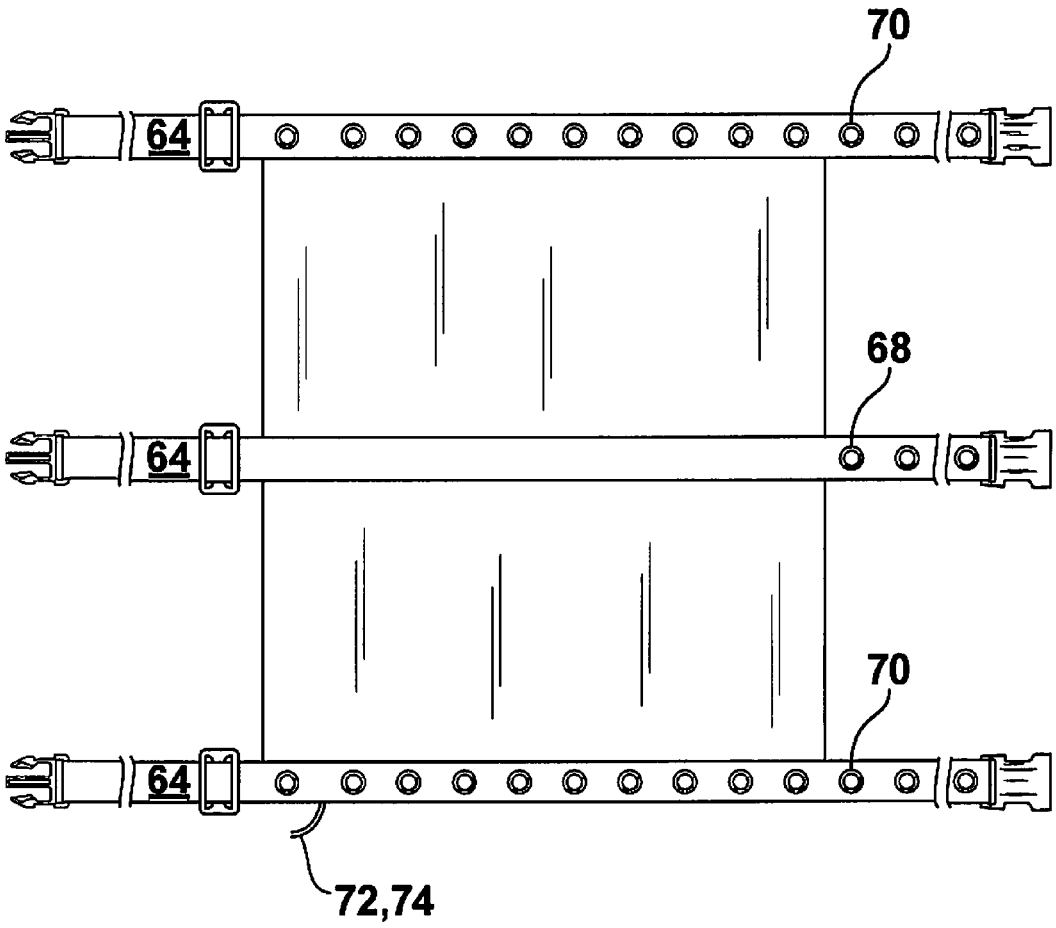
FIG. 9 is a plan view thereof showing the side of road-side signal side which faces inwardly towards the pole's surface and has a plurality of securing eyelet mounting components for facilitating the nailing thereof to the pole's surface.

In the second embodiment, shown in FIGS. 7 and 8, the securement devices comprise regularly spaced openings 68 in the attachment straps 42. The regularly spaced openings 68 are for securing the straps 42 to a utility pole 49, streetlight 48 or other appropriate location by driving of a nail, screw, or other drivable fastener into the pole through the openings 68.

The regularly spaced openings 68 are in a preferred construction reinforced around their edges by grommets 70.

CONCLUSION

In view of the above, it is disclosed that in the preferred embodiment of the present invention, the roadside signal is not connected to a power or communications grid. However, an alternate embodiment is also shown, particularly in FIG. 8 the signal 12 further comprises a backup power source 72. The backup power source 72 comprises a direct connection to a power grid 74.

It will be understood that each of the elements described above, or two or more together, may also find a useful application in other types of constructions differing from the types described above.

While the invention has been illustrated and described as embodiments of an EARLY WARNING SYSTEM OF EMERGENCY VEHICLES FOR ALERTING ROADWAY TRAFFIC, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A roadside signal for alerting vehicles to a stopped responder vehicle or other hazard which comprises:

a) a plurality of illumination means;
b) a power source;
c) a plurality of attachment straps;
d) a plurality of securement means; and
e) a flexible backing;

wherein said plurality of illumination means are for alerting vehicles;

wherein said power source is for powering said plurality of illumination means;

wherein said plurality of attachment straps are for encircling a utility pole, streetlight, or other appropriate location for mounting said signal;

wherein said plurality of securement means are for securing said signal to the utility pole, streetlight, or other appropriate location for mounting said signal;

wherein said flexible backing is for holding said plurality of illumination means in place;

wherein said power source comprises:

a) at least one solar panel; and
b) at least one battery;

wherein said at least one battery powers said illumination means and is powered by said at least one solar panel;

wherein said plurality of illumination means are arranged in a regular pattern;

wherein there are spaces between said plurality of illumination means;

wherein said at least one solar panel comprises a plurality of solar panels;

wherein said plurality of solar panels are located in said spaces between, and are coplanar with, said illumination means;

wherein said at least one battery comprises a plurality of batteries;

wherein said plurality of batteries corresponds to said plurality of solar panels;

wherein said each of said plurality of batteries is mounted behind, and is in top-to-bottom alignment with, a corresponding solar panel;

wherein said attachment straps have:

a) a proximal face; and
b) as distal face;

wherein at least part of said proximal face is permanently secured to said flexible backing;

wherein said distal face abuts the utility pole, streetlight, or other appropriate location for mounting said signal;

wherein said securement means comprises one of:

permanent magnets; and regularly spaced openings in said attachment straps;

wherein when said securement means comprises said permanent magnets:

a) said permanent magnets are mounted on said distal face of said attachment straps; and b) said permanent magnets are for securing said signal to a utility pole, streetlight, or other appropriate location which is substantially ferromagnetic; and wherein when said securement means comprises said regularly spaced openings in said attachment straps:

a) said regularly spaced openings are for securing the straps to a utility pole, streetlight or other appropriate location by driving of a nail, screw, or other drivable fastener into the pole through said opening; and b) said regularly spaced openings are reinforced around its edge by a grommet.

2. The signal of claim 1 wherein said signal further comprises a pulse control circuit; and wherein said pulse control circuit is for pulsing said plurality of illumination means to better alert vehicles.

3. The signal of claim 1 wherein said plurality of illumination means comprise a plurality of light emitting diode illumination means.

4. The signal of claim 1 wherein said signal further comprises a backup power source; and wherein said backup power source comprises a direct connection to a power grid.

5. The signal of claim 1, further comprising:

a) a computer;

b) a communications network; and c) a communications interface;

wherein said signal communicates through said communications interface over said communications network with said computer; and wherein said computer causes said signals to illuminate said illumination means thereof for the purpose of alerting traffic.

6. The signal of claim 5 wherein said computer causes said signal to pulse said illumination means.

7. The signal of claim 6 wherein said communications network is a wireless communications network; and wherein said communications interface comprises a wireless communications transponder.

8. The signal of claim 7, further comprising a road network database;

wherein said road network database contains information about the location of said signal on said road network; and wherein said computer selects said signal for illumination based on its location.

9. The signal of claim 8 wherein the signal comprises at least one responder vehicle; and wherein said at least one responder vehicle is in communication with said computer via said wireless communications network.

10. The signal of claim 9 wherein said at least one responder vehicle has a Global Positioning System location means thereon; and wherein a location of said at least one responder vehicle ascertained by said Global Positioning System location means is communicated to said computer via said wireless communications network.

11. The signal of claim 10 wherein said at least one responder vehicle has a roadside signal toggle switch; and wherein said roadside signal toggle switch is for selectively activating or deactivating said signal that is on the same road as the location of said responder vehicle and which is within a pre-determined proximity of said responder vehicle.

12. The signal of claim 10 wherein said responder vehicle has a speedometer; and wherein said speedometer communicates with said computer via said wireless communications network.

13. The signal of claim 12 wherein said computer operates a logic system for activating said signal; and wherein said logic system is for automatically activating said signal when certain conditions are met, and for deactivating said signal when other conditions are met.

14. The signal of claim 13 wherein said computer is connected to a centralized user control; and wherein said centralized user control selectively activates and deactivates said signal.

15. The signal of claim 14 wherein said centralized user control has ultimate control over the activation or deactivation of said signal, and deactivates said signal activated by said roadside toggle switch or said logic system, or activates said signal if inactive.

16. The signal of claim 15 wherein said centralized user control locks out any roadside toggle switch or said logic system from activating said signal.

* * * * *